US007229158B2

(12) United States Patent
Park et al.

(10) Patent No.: US 7,229,158 B2
(45) Date of Patent: Jun. 12, 2007

(54) PROTECTIVE LAYER OF INK-JET PRINT HEAD AND METHOD OF MAKING INK-JET PRINT HEAD HAVING THE SAME

(75) Inventors: Sung-joon Park, Suwon-si (KR); O-hyun Beak, Seoul (KR); Young-ung Ha, Suwon-si (KR); Jae-sik Min, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 240 days.

(21) Appl. No.: 10/918,489

(22) Filed: Aug. 16, 2004

(65) Prior Publication Data

US 2005/0046677 A1 Mar. 3, 2005

(30) Foreign Application Priority Data

Aug. 25, 2003 (KR) ..... 10-2003-0058884

(51) Int. Cl.
*B41J 2/05* (2006.01)

(52) U.S. Cl. ..... 347/64; 347/63; 347/65

(58) Field of Classification Search ..... 347/20, 347/56, 61–65, 67

See application file for complete search history.

(56) References Cited

U.S. PATENT DOCUMENTS

| | | | | |
|---|---|---|---|---|
| 4,335,389 | A | 6/1982 | Shirato et al. | 347/64 |
| 5,883,650 | A | 3/1999 | Figueredo et al. | 347/62 |
| 6,209,991 | B1 | 4/2001 | Regan et al. | 347/63 |
| 6,582,070 | B2 * | 6/2003 | Takada et al. | 347/65 |
| 6,607,264 | B1 * | 8/2003 | Cox et al. | 347/64 |

FOREIGN PATENT DOCUMENTS

| | | |
|---|---|---|
| CN | 1253078 A | 5/2000 |
| JP | 60-109850 | 6/1985 |
| JP | 06-297713 | 10/1994 |
| JP | 2002-052724 | 2/2002 |
| KR | 00186576 | 12/1998 |
| KR | 10-2002-0025588 A | 4/2002 |

* cited by examiner

*Primary Examiner*—Juanita D. Stephens
(74) *Attorney, Agent, or Firm*—Roylance, Abrams, Berdo & Goodman, LLP

(57) ABSTRACT

An ink-jet print head and a method of making the same comprising the steps of sequentially laminating a heating layer and an electric conductive layer on a substrate, patterning the electric conductive layer to expose a predetermined area of the top surface of the heating layer, forming a protective layer on the top surfaces of the electric conductive layer and exposed heating layer, and laminating an ink chamber barrier and a nozzle plate on the top surface of the protective layer, thereby forming an ink chamber. The protective layer is provided by forming a cavitation layer by alternately laminating at least two types of thin film layers of different materials over the exposed heating layer and the electric conductive layer to resist fractures and oxidization resulting from use.

35 Claims, 6 Drawing Sheets

PROTECTIVE LAYER OF INK-JET PRINT HEAD AND METHOD OF MAKING INK-JET PRINT HEAD HAVING THE SAME

CROSS-REFERENCE TO RELATED APPLICATIONS

This application claims the benefit under 35 U.S.C. §119 (a) of Korean Patent Application No. 2003-58884 entitled "Protective Layer Of Ink-Jet Print Head And Method Of Making Ink-Jet Print Head Having The Same", filed in the Korean Intellectual Property Office on Aug. 25, 2003, the entire contents of which are incorporated herein by reference.

BACKGROUND OF THE INVENTION

1. Field of the Invention

The present invention relates to an ink-jet print head. More particularly, the present invention relates to a protective layer formed for protecting a heating layer of a thermal transfer ink-jet print head and a method of making a print head provided with such a protective layer.

2. Description of the Related Art

In conventional print head applications, two ink ejection techniques have been widely employed in ink-jet print heads. A first technique is to eject ink using a piezoelectric element, and the second technique is to eject ink using ink bubbles produced when instantaneously heating the ink with a heating element. The latter technique is commonly called a thermal transfer technique. Recently, ink-jet print heads of the thermal transfer type have been more commonly used because they can be more easily fabricated in a compact size.

FIG. 1 shows a partial cross-sectional view of the construction of an example conventional ink-jet print head of the thermal transfer type.

Referring to FIG. 1, a conventional ink-jet print head 100 comprises a heating layer 140, an electric conductive layer 150, and a protective layer 160, which are all laminated on a main substrate 120 in the order shown. The heating layer 140 is formed to instantaneously heat ink charged within an ink chamber 110 as described above, and the electric conductive layer 150 is formed for applying electric power to the heating layer 140.

The protective layer 160 is formed for protecting the heating layer 140. In this regard, the conventional protective layer 160 can comprise an insulation layer 164 which is formed over the heating layer 140 and the electric conductive layer 150, and a cavitation layer 161 which is formed on the top surface of the insulation layer 164, as disclosed in U.S. Pat. No. 4,335,389 of Yoshiaki Shirato et al., entitled "Liquid Droplet Ejecting Recording Head", the entire contents of which are incorporated herein by reference.

The cavitation layer 161 serves to prevent the heating layer 140 from being fractured by a cavitation force produced when ink bubbles (not shown) collapse within the ink chamber 110 after ink droplets are ejected through a nozzle 185. To achieve this function, the conventional cavitation layer 161 can be formed by depositing tantalum (Ta) on the top surface of the insulation layer 164.

In order to protect the heating layer 140 from a cavitation force as described above, a cavitation layer 161 should be wholly superior to remaining layers not only in mechanical properties, such as hardness and elasticity, but also in chemical properties, such as oxidation resistance, for preventing the layer from being readily oxidized by ink charged within an ink chamber 110. However, it is difficult to find such a material that is wholly superior in the aforementioned properties and in particular, it is even more difficult to find such a material that is wholly superior in these properties when incorporated in a thin film layer state in a product.

As an example, a conventional cavitation layer 161 comprised of tantalum (Ta) as mentioned above, is superior in elasticity. However, it is not so superior in hardness and oxidation resistance that it can protect a heating layer 140 for a long period. As a result, if a conventional ink-jet print head 100 is repeatedly used for a long period, the projective layer 160 will be fractured, either by cavitation forces as mentioned above, or by oxidization due to chemical reactions with ink charged within the ink chamber 110. Therefore, a problem arises in that it can become impossible to prevent the heating layer 140 from being damaged. In particular, as ink-jet printers for high-speed printing are being vigorously developed, there is problem in that the replacement period of an ink-jet print head 100 has become shorter and shorter due to the fracture of the heating layer 140 as described above.

Accordingly, a need exists for a system and method to provide an ink-jet print head which can be repeatedly used for a long period with minimal damage to the projective layer by forces such as cavitation and oxidization.

SUMMARY OF THE INVENTION

Accordingly, the present invention has been made to solve the above-mentioned and other problems occurring in the prior art, and an object of the present invention is to provide an ink-jet print head which is provided with a protective layer, such that the durability and reliability of the ink-jet print head can be enhanced, and to provide a method of making the same.

In order to achieve the above and other objects, according to embodiments of the present invention, a protective layer of an ink-jet print head is provided comprising a cavitation layer formed on the top surface of a heating layer for preventing the heating layer from being mechanically fractured due to cavitation forces generated when ink bubbles collapse. The cavitation layer is formed by sequentially laminating at least two types of thin film layers of different materials on the top of the heating layer, and wherein the at least two types of thin film layers are alternately laminated.

Embodiments of the present invention further provide an ink-jet print head which comprises a main substrate, an ink chamber formed on the main substrate to be capable of receiving ink introduced through an ink feeding passage, wherein the ink chamber is formed with a nozzle for ejecting ink droplets at a side thereof, a heating layer laminated on the bottom of the ink chamber, an electric conductive layer laminated on the top surface of the heating layer in a given shape such that a predetermined area of the heating layer is exposed in the interior of the ink chamber, and a protective layer laminated over the electric conductive layer and the exposed heating layer. The protective layer comprises a cavitation layer formed in such a way that at least two types of thin film layers, which are respectively formed of different materials, are alternately laminated over the exposed heating layer and the electric conductive layer.

According to embodiments of the present invention, the cavitation layer comprises at least one first thin film layer formed of tantalum (Ta), and at least one second thin film layer formed of tantalum nitride ($TaN_x$), which can be formed by nitrification of the Ta.

It is preferred that the thickness of the cavitation layer described above is equal to the total respective thicknesses of the first and second thin film layers.

In addition, it is preferred that at least one of the uppermost and lowermost surfaces of the cavitation layer is provided with the second thin film layer. More preferably, the thickness T of the cavitation layer is defined by the following equation (1):

$$T=nt_1+(n+1)t_2 \quad (1)$$

wherein T is a total thickness of the cavitation layer, n is the number of first thin film layers, $t_1$ is a thickness of each first thin film layer, and $t_2$ is a thickness of each second thin film layer.

In this case, it is preferred that all of the respective first thin film layers and respective second thin film layers have a substantially equal thickness.

It is also preferred that the protective layer further comprises an insulation layer formed between the top surfaces of the heating layer and the exposed conductive layer, and the bottom surface of the cavitation layer, and that the insulation layer is preferably formed of silicon nitride ($SiN_x$).

It is further preferred that the ink chamber is surrounded about its periphery by an ink chamber barrier which is laminated on the protective layer, and a nozzle plate which is laminated on the top surface of the ink chamber barrier and through which the nozzle is formed. It is more preferable that the nozzle and the ink feeding passage are coaxially located.

According to embodiments of the present invention as described above, the hardness, elasticity and oxidation resistance are wholly enhanced, whereby the durability and reliability of the ink-jet print head can be enhanced.

A method of making an ink-jet print head according to embodiments of the present invention as described above comprises steps of sequentially laminating a heating layer and an electric conductive layer on a substrate, patterning the electric conductive layer to expose a predetermined area of the top surface of the heating layer, forming a protective layer over the electric conductive layer and the exposed heating layer, and laminating an ink chamber barrier and a nozzle plate on the top surface of the protective layer, thereby forming an ink chamber. The step of forming the protective layer further comprises the step of forming a cavitation layer by alternately laminating at least two types of thin film layers of different materials over the heating layer and the exposed electric conductive layer.

The cavitation layer is formed by depositing at least one first thin film layer formed of Ta and at least one second thin film layer formed of $TaN_x$ on the top surfaces of the heating layer and electric conductive layer in such a way that the first and second thin film layers are alternately laminated.

It is preferred that the at least one first thin film layer is formed through a sputtering process, and that the second thin film layer is formed through a reactive sputtering process, in which a gaseous state $N_2$ is introduced during the sputtering process such that the Ta of the second thin film layer is deposited in a nitrified state. The step of forming the cavitation layer is performed by periodically repeating the sputtering process and the reactive sputtering process over a predetermined length of time to produce an alternately laminated layer.

It is also preferred that the step of forming the protective layer comprises the step of depositing $SiN_x$ to cover the top surfaces of the exposed heating layer and the electric conductive layer, thereby forming an insulation layer wherein the cavitation layer is laminated on the top surface of the insulation layer.

The ink chamber barrier and the nozzle plate are preferably formed by a monolithic laminating method, in which the ink chamber barrier and the nozzle plate are preferably formed of an epoxy or a metal.

BRIEF DESCRIPTION OF THE DRAWINGS

The above and other objects, features and advantages of the present invention will be more apparent from the following detailed description taken with reference to the accompanying drawings, in which.

DETAILED DESCRIPTION OF THE EXEMPLARY EMBODIMENTS

Hereinbelow, the present invention will be described in greater detail with reference to the accompanying drawings.

Figure 2:
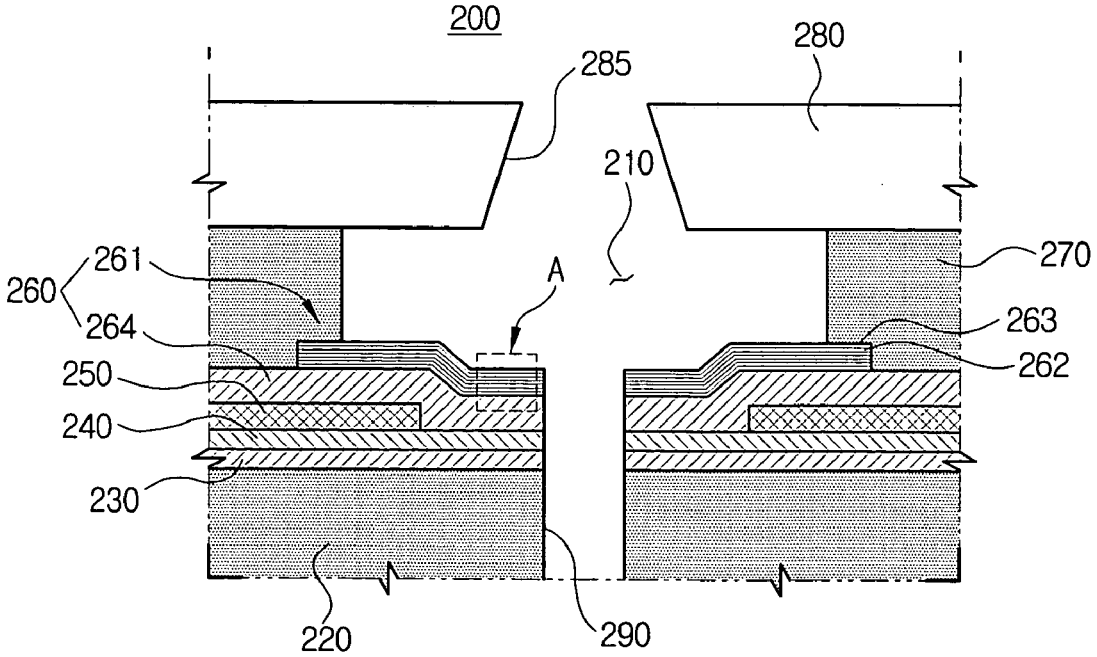
FIG. 2 is a cross-sectional view showing an example ink-jet print head according to an embodiment of the present invention.

FIG. 2 is a cross-sectional view which shows a construction example of an ink-jet print head according to an exemplary embodiment of the present invention.

Referring to FIG. 2, the ink-jet print head 200 can be a thermal transfer ink-jet print head of top ejection type, and comprise a main substrate 220, a heating layer 240, an electric conductive layer 250, a protective layer 260, an ink chamber barrier 270 and a nozzle plate 280.

The heating layer 240 serves to instantaneously heat ink charged within an ink chamber 210 defined by the ink chamber barrier 270 and the nozzle plate 280, and is preferably formed of a tantalum aluminum (Ta—Al) alloy. It is preferable that an additional heat insulation layer 230 of silicon dioxide (SiO2) is formed between the heating layer 240 and the main substrate 220, thereby preventing heat generated from the heating layer 240 from being transferred to the main substrate 220.

The electric conductive layer 250 serves to apply electric power to the heating layer 240 and is preferably formed of aluminum (Al), which has a high degree of electric conductivity.

The protective layer 260 comprises an insulation layer 264 and a cavitation layer 261.

The insulation layer 264 of the protective layer 260 serves to insulate ink charged into the ink chamber from the electric conductive layer 250, and is preferably formed of silicon nitride ($SiN_x$) that is superior in electric insulation property and heat transfer efficiency.

The cavitation layer 261 serves to prevent the heating layer 240 from being fractured by cavitation forces generated when ink bubbles collapse within the ink chamber 210 after the ink ejection through the nozzle 285 is completed.

Figure 3:
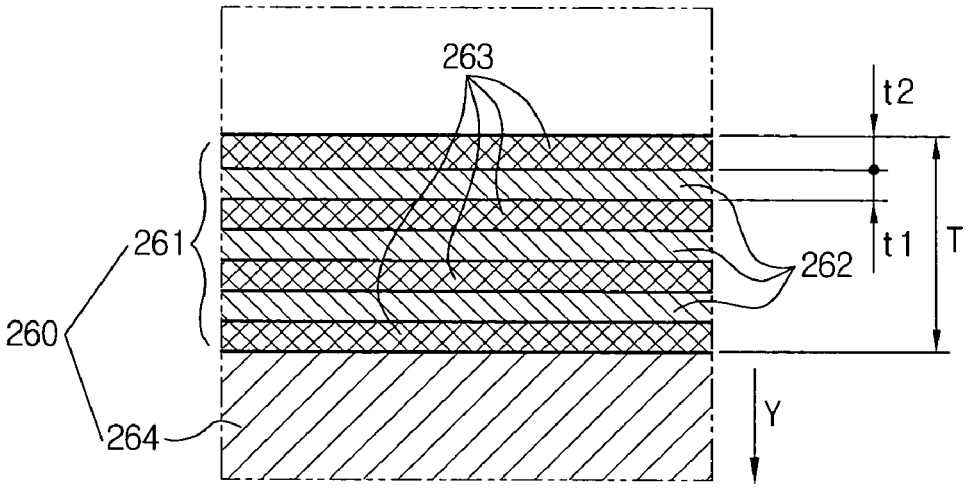
FIG. 3 is a cross-sectional view showing the section labeled "A" in FIG. 2 in greater detail.

As shown in FIG. 3, the cavitation layer 261 according to embodiments of the present invention, can be formed by sequentially laminating a plurality of thin film layers 262 and 263 on the top surface of the insulation layer 264.

Figure 4:
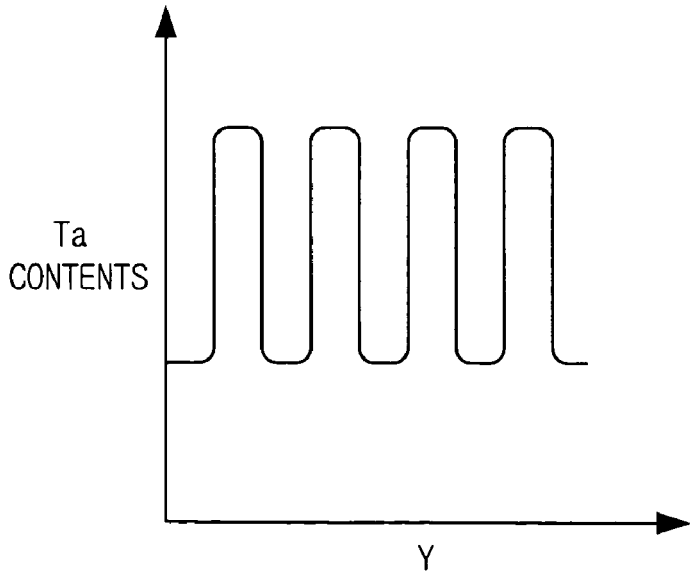
FIG. 4 is a graph showing an example of the variation of Ta contents in a cavitation layer shown in FIG. 2.

The cavitation layer 261 in this embodiment is formed by alternately and repeatedly laminating a plurality of first thin film layers 262 formed of tantalum (Ta) and a plurality of second thin film layers 263 formed of tantalum nitride (TaNx), which is inferior to Ta in elasticity but superior to Ta in mechanical hardness and oxidation resistance, on the top surface of the insulation layer 264. For reference, the bonding energy of Ta, E(Ta—Ta)=88 kcal/mol and the bonding energy of $TaN_x$, E(Ta—$N_x$)=146 kcal/mol. The variation of Ta contents in the cavitation layer 261 formed as described above is shown in FIG. 4.

The lamination of first thin film layers 262 is preferably performed by a conventional vacuum deposition method such as sputtering. It is possible to form the second thin film layers 263 by using various deposition processes, such as chemical vapor deposition (CVD). If the first thin film layers 262 are formed of Ta as in this embodiment, it is preferable to deposit Ta in the nitrified state through reactive sputtering, during which $N_2$ gas is introduced over a predetermined length of time while Ta is being deposited. In this case, it is possible to employ a time-divisional deposition method, which uses a conventional vacuum deposition facility and during which gaseous N2 is periodically introduced into the vacuum deposition facility while Ta is being deposited, whereby it is possible to alternately and repeatedly laminate first and second thin film layers 262 and 263 in a simple manner. If the second thin film layers 263 are deposited while Ta is being nitrified as described above, the thickness of each second thin film layer 263 is determined by controlling the length of time for introducing $N_2$ gas.

It is preferable that all the respective first and second thin film layers 262 and 263 are formed having a substantially equal thickness. In this case, the entire property of the cavitation layer 261 can be easily adjusted by controlling the number of laminated first and second thin film layers 262 and 263. According to this layering feature, even if the internal construction of an ink-jet print head is changed, it is possible to adjust the entire property of the cavitation layer.

If two types of thin film layers, such as layers 262 and 263, are alternately laminated to form the cavitation layer 261 as described above, the thickness of the cavitation layer 261 is equal to the total of thicknesses of the first and second thin film layers 262 and 263. In the case of an ink-jet printer example in the present embodiment, the cavitation layer 261 is typically formed to have a thickness T of about 5000Å, and each of the first and second thin film layers is preferably formed to have a thickness $t_1$ and $t_2$ of about 50Å to about 500Å. In particular, in order to maintain inherent properties of respective thin film layers 262 and 263, and to further render the entire properties of the laminated cavitation layer 261 to be easily controlled, it is most preferable that each of the first and second thin film layers 262 and 263 has a thickness $t_1$ and $t_2$ of about 100 Å, with the result that about twenty five layers of first thin film layers and about twenty five layers of second thin film layers are provided in the laminated layer 261. For reference, FIG. 3 shows an example cavitation layer provided with three first thin film layers 262 and four second thin film layers 263 in order to simplify the drawing and detailed description.

It is preferable that the cavitation layer 261 as described above is provided with the second thin film layers 263 on both of the lowermost surface contacting the insulating surface, and the uppermost surface exposed to the ink-chamber 210. This is because $TaN_x$ is superior to Ta in adhesive force with the insulation layer 264, as well as in hardness and oxidation resistance as described above. In this case, the first thin film layers 262 formed of Ta, which is superior to $TaN_x$ in elasticity, retains the entire elasticity of the cavitation layer 261. The hardness of the cavitation layer 261 is increased by $TaN_x$ to a predetermined level, thereby preventing the cavitation layer 261 from being easily fractured due to cavitation forces of ink bubbles.

The cavitation layer 261, specifically the combination of first and second thin film layers 262 and 263, is provided as expressed by equation (1), which is repeated below.

$$T=nt_1+(n+1)t_2 \quad (1)$$

Herein, T is a total thickness of cavitation layer 261, n is the number of first thin film layers 262, $t_1$ is a thickness of each first thin film layer, and $t_2$ is a thickness of each second thin film layer 263.

Figure 1:
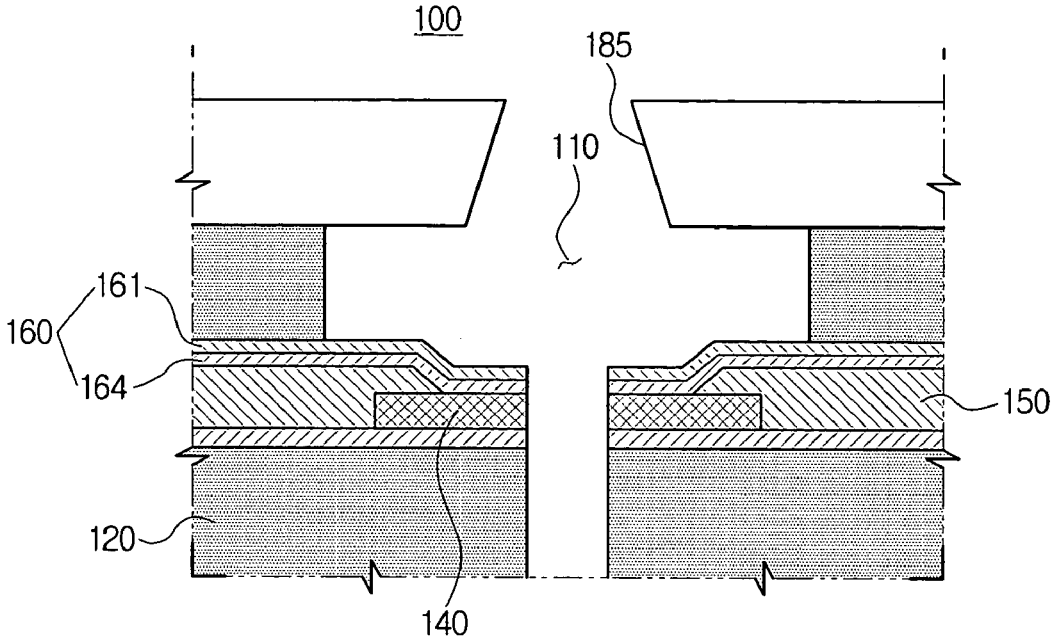
FIG. 1 (PRIOR ART)
FIG. 1 is a cross-sectional view showing an example conventional ink-jet print head.

If the cavitation layer 261 is formed by alternately laminating the first thin film layers 262 and the second thin film layers 263 as described above, the hardness and oxidation resistance become superior to those of a conventional cavitation layer 161 formed of a single material, Ta (see FIG. 1), whereby it is possible to efficiently prevent a heating layer 240 from being fractured even if an ink-jet print head 200 is repeatedly driven over a long period. Accordingly, it is possible to enhance the durability of the ink-jet print head 200.

Hereinbelow, an example method of making an ink-jet print head according to an exemplary embodiment of the present invention is described in detail with reference to FIGS. 5A to 5I.

Figure 5A:
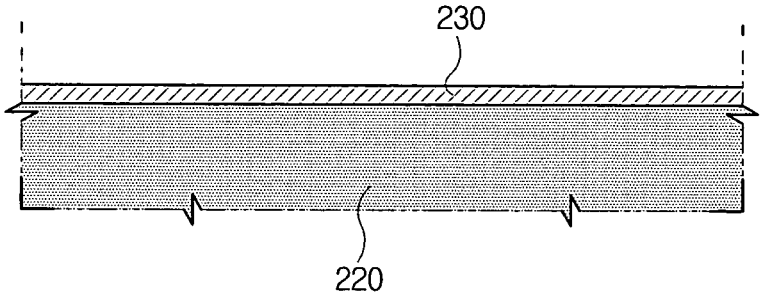
FIGS. 5A to 5I are sequential cross-sectional views showing a method of making an ink-jet print head according to an embodiment of the present invention.

As shown in FIG. 5A, a heat insulation layer 230 is first formed on a main substrate 220. At this time, it is preferable that the material of the heat insulation layer 230 is silicon dioxide ($SiO_2$), which has good heat insulation efficiency.

Figure 5B:
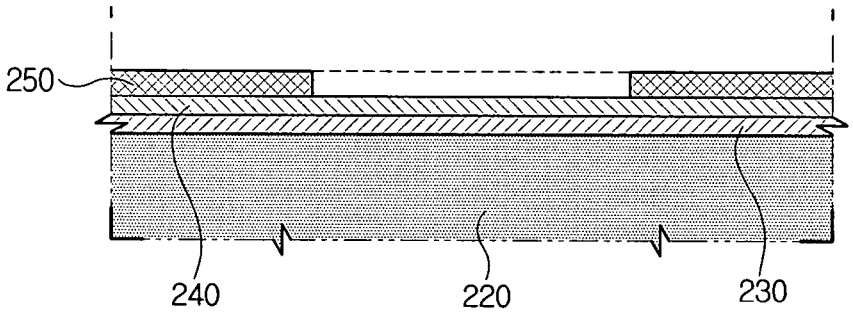

Then, as shown in FIG. 5B, a heating layer 240 and an electric conductive layer 250 are deposited on the top surface of the heat insulation layer 230 and the electric conductive layer 250 is patterned through an etching process such as lithography, to expose a predetermined area of the top surface of the heating layer 240. At this time, the heating layer 240 is preferably formed through vacuum deposition of a heating resistance material formed of tantalum aluminum (Ta—Al) alloy and the electric conductive layer 250 is preferably formed through vacuum deposition of a conductive material formed of aluminum (Al).

As described above, if the formation of the heating layer 240 and the electric conductive layer 250 is completed, a protective layer 260 is formed. As described above, the protective layer 260 in this embodiment comprises an insulation layer 264 and a cavitation layer 261.

Figure 5C:
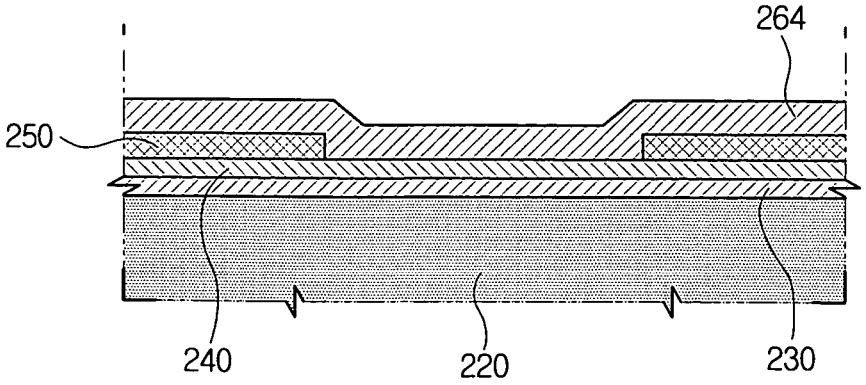

Here, the insulation layer 264 is formed over the exposed heating layer 240 and the conductive layer 250 as shown in FIG. 5C. The insulation layer 264 is preferably formed over the exposed heating layer 240 and the conductive layer 250 through a method such as plasma enhanced chemical vapor deposition (PECVD).

Figure 5D:
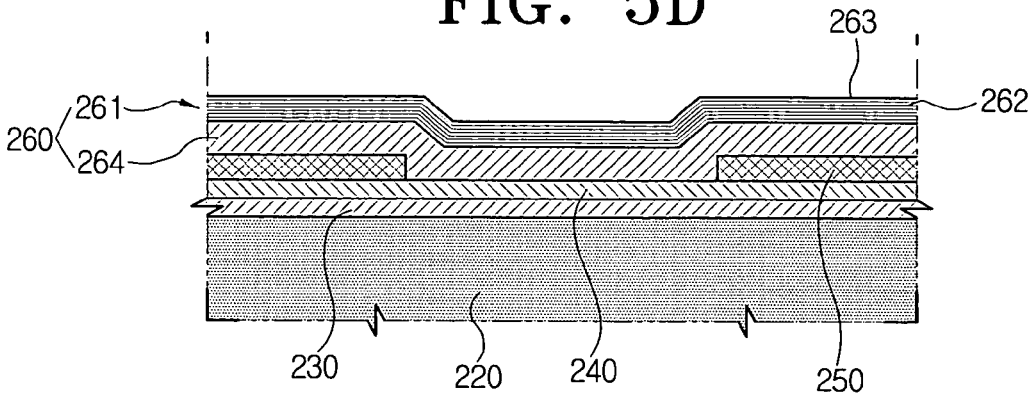

The cavitation layer 261 is laminated on the top surface of the insulation layer 264. The cavitation layer 261 in this embodiment is formed by alternately laminating three first thin film layers 262 formed of tantalum (Ta), and four second thin film layers 263 formed of tantalum nitride ($TaN_x$) on the top surface of the insulation layer 264 as shown in FIG. 5D. At this time, it is preferable that the first and second thin film layers 262 and 263 are formed through sputtering and reactive sputtering as described above, and it is also preferable to arrange the second thin film layers 263 on the top and bottom surfaces of the cavitation layer 261.

Figure 5E:
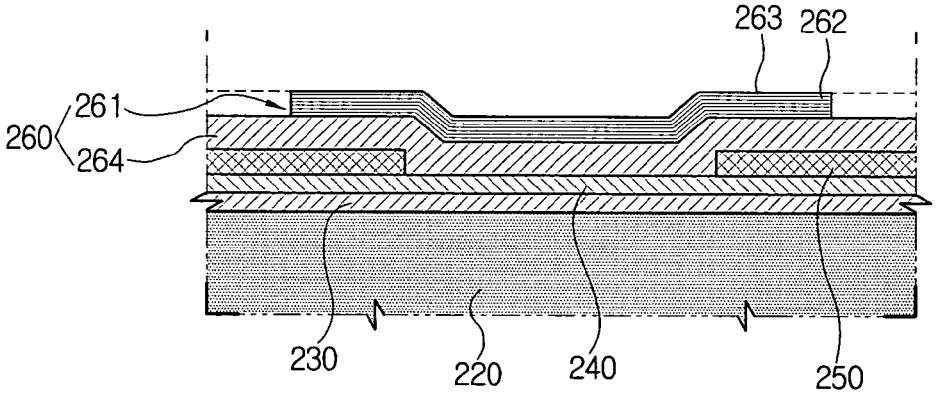

FIG. 5E shows the cavitation layer 261 patterned for laminating an ink chamber barrier 270, as shown in FIG. 2. At this time, it is preferable to pattern the cavitation layer 261 in such a way that a part of the periphery of the cavitation layer 261 underlies the ink chamber barrier 270 slightly. This serves to prevent the cavitation layer 261 from being peeled from the insulation layer 264, and serves to directly bond the ink chamber barrier 270, which has a superior adhesive force with $SiN_x$ rather than with Ta or $TaN_x$, to the insulation layer 264.

Figure 5F:
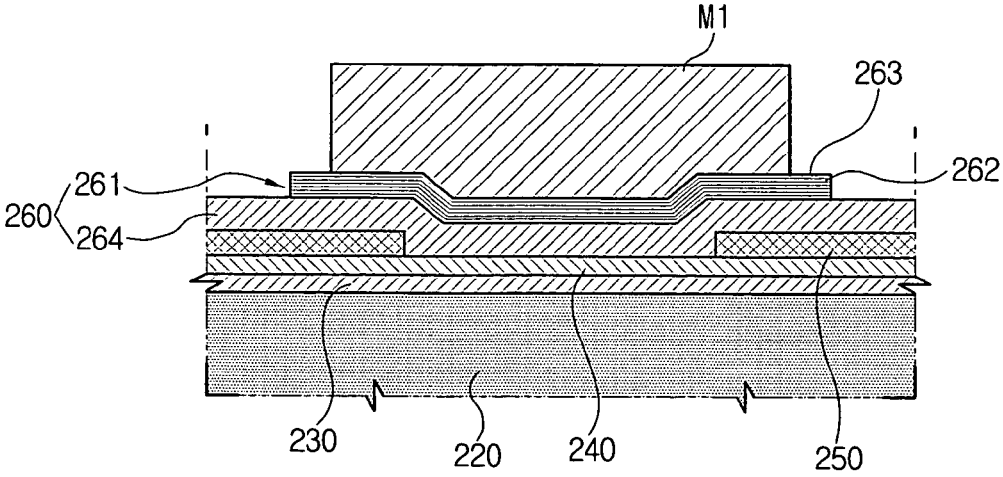

FIG. 5F shows a state in which a photoresist mold M1 has been laminated and then patterned on the top surface of the cavitation layer 261.

Figure 5G:
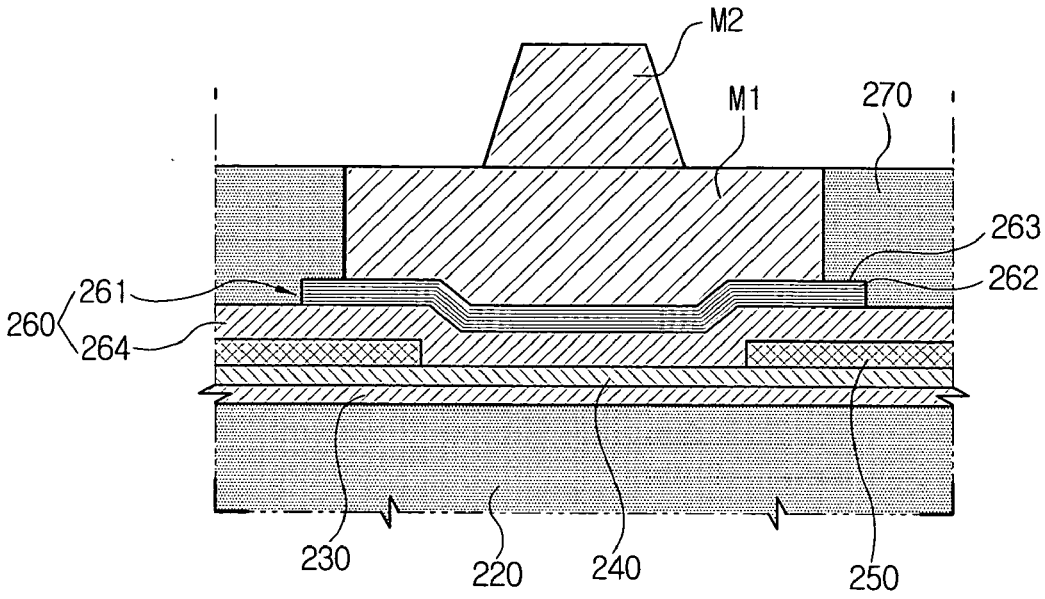
Figure 5H:
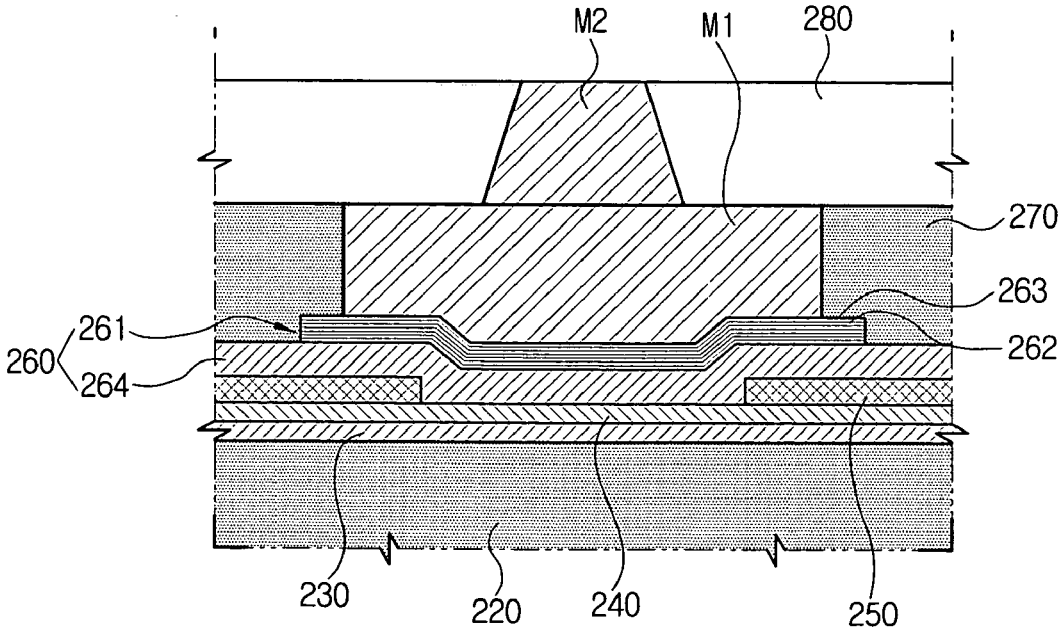

Once the patterning of the photoresist molds M1 is completed, a metallic material or epoxy is deposited to fill the spaces formed between such photoresist molds M1 as shown in FIG. 5G This method of forming an ink chamber carrier 270 is referred to as a monolithic lamination method, which enables an ink-jet print head 200 to be miniaturized and integrated in an easy manner. If the ink chamber barrier 270 is formed through the monolithic lamination method as described above, it is preferable that a nozzle plate 280 having a nozzle 285 (FIG. 5I) is also formed through the monolithic lamination method using a patterned photoresist mold M2 as shown in FIGS. 5G and 5H.

If the ink chamber barrier 270 is adhered to the top surface of the cavitation layer 261 rather than the insulation layer 264 as shown, it is possible to omit the patterning process of the cavitation layer as described above, however, if the chamber barrier 270 and the cavitation layer 261 are adhered with each other, a separate adhesive layer (not shown) can be required.

Figure 5I:
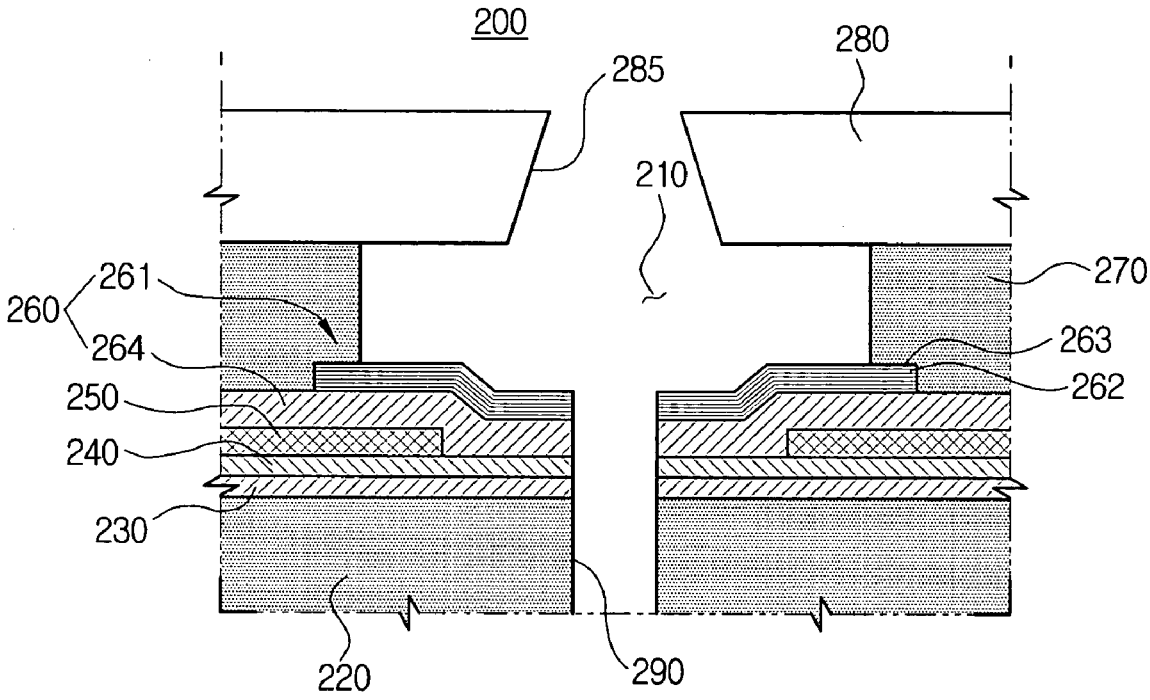

If the lamination of the nozzle plate 280 is completed as described above, the photoresist molds M1 and M2 are removed through an etching process to form the ink chamber 210 as shown in FIG. 5I. Then, in order to form an ink feeding passage 290, the heat insulation layer 230, the heating layer 240, the protective layer 260 and the main substrate 220 are etched. At this time, it is preferable to arrange the ink feeding passage 290 coaxially with the nozzle 285, thereby facilitating miniaturization of the ink-jet print head. Typically, the ink feeding passage 290 is preferably formed through a dry etching process.

In the above embodiments, for the purpose of illustrating the present invention, a thermal transfer ink-jet print head of top ejection type is described by way of an example. However, a cavitation layer according to embodiments of the present invention is applicable to any types of ink-jet print heads if they have a cavitation layer in order to prevent a heating layer from being fractured due to collapse of ink bubbles. In addition, it is also possible to form individual components of such ink-jet print heads by using various deposition methods.

According to embodiments of the present invention as described above, by forming a cavitation layer in such a manner that a plurality of thin film layers formed of different materials are alternately and repeatedly laminated, it is possible to wholly enhance mechanical hardness, elasticity and oxidation resistance of the cavitation layer. As a result, even if the ink-jet print head is repeatedly used over a long period, it is possible to suppress the fracture of the heating layer, whereby the durability and reliability of the ink-jet print head can be enhanced.

There is also an effect that embodiments of the present invention provide an easy method to form a cavitation layer to have a desired hardness and elasticity, which can be demanded having different characteristics according to the constructions of ink-jet print heads.

While the preferred embodiments of the present invention have been shown and described with reference to preferred embodiments thereof, the present invention is not limited to these embodiments. It will be understood that various modifications and changes can be made by those skilled in the art without departing from the spirit and scope of the invention as defined by the appended claims. Therefore, it shall be considered that such modifications, changes and equivalents thereof are all included within the scope of the present invention.

What is claimed is:

1. A protective layer of an ink-jet print head, which is formed on the top of a heating layer for heating ink charged in an ink chamber of the ink-jet print head, the protective layer comprising:

a cavitation layer for preventing the heating layer from being mechanically fractured, wherein the cavitation layer is formed by sequentially laminating alternating pluralities of first and second film layers comprising at least two types of thin film layers, which are formed of different materials, on the top of the heating layer, wherein the uppermost and lowermost surfaces of the cavitation layer are provided with the second thin film layer.

2. The protective layer according to claim 1, wherein the alternating pluralities of first and second film layers of the cavitation layer comprise:

a plurality of a first thin film layer type formed of tantalum (Ta), and a plurality of a second thin film layer type formed of tantalum nitride ($TaN_x$).

3. The protective layer according to claim 2, wherein the second thin film layer is formed by the nitrification of the Ta.

4. The protective layer according to claim 2, wherein the thickness of the cavitation layer is substantially equal to the total of respective thicknesses of the first and second thin film layers.

5. The protective layer according to claim 2, wherein the first thin film layers are formed having a substantially equal thickness, and the second thin film layers are formed having a substantially equal thickness, and wherein the thickness T of the cavitation layer is defined by the following equation:

$$T=nt_1+(n+1)t_2$$

wherein T is a total thickness of the cavitation layer, n is the number of first thin film layers, $t_1$ is a thickness of each first thin film layer, and $t_2$ is a thickness of each second thin film layer.

6. The protective layer according to claim 2, wherein the first thin film layers and second thin film layers are formed having a substantially equal thickness.

7. The protective layer according to claim 2, further comprising an insulation layer formed between the heating layer and the cavitation layer.

8. The protective layer according to claim 1, wherein the cavitation layer substantially prevents mechanical fracture due to a cavitation force generated when ink bubbles collapse or due to oxidization.

9. An ink-jet print head comprising:

a main substrate;

an ink chamber formed on the main substrate to be capable of receiving ink introduced through an ink feeding passage, wherein the ink chamber is connected with a nozzle for ejecting ink droplets at a side thereof;

a heating layer laminated on the bottom of the ink chamber;

an electric conductive layer laminated on the top surface of the heating layer in a given shape such that a predetermined area of the heating layer is exposed in the interior of the ink chamber; and a protective layer laminated over the electric conductive layer and the heating layer, wherein the protective layer comprises a cavitation layer, formed having at least two types of thin film layers which are formed of different materials, comprising sequentially laminated alternating pluralities of the first and second film layers on the heating layer and the electric conductive layer.

10. The ink-jet print head according to claim 9, wherein the cavitation layer comprises:

the plurality of first thin film layer types formed of tantalum (Ta); and plurality of second thin film layer types formed of tantalum nitride (TaN*x*).

11. The ink-jet print head according to claim 10, wherein the plurality of second thin film layers are formed by nitrification of the Ta.

12. The ink-jet print head according to claim 10, wherein the thickness of the cavitation layer is substantially equal to the total of respective thicknesses of the first and second thin film layers.

13. The ink-jet print head according to claim 10, wherein the uppermost and lowermost surfaces of the cavitation layer are provided with the second thin film layer.

14. The ink-jet print head according to claim 10, wherein the plurality of first thin film layers are formed having a substantially equal thickness, and the plurality of second thin film layers are formed having a substantially equal thickness, and wherein the thickness T of the cavitation layer is defined by the following equation:

$$T=nt_1+(n+1)t_2$$

wherein T is a total thickness of the cavitation layer, n is the number of first thin film layers, $t_1$ is a thickness of each first thin film layer, and $t_2$ is a thickness of each second thin film layer.

15. The ink-jet print head according to claim 9, wherein the protective layer further comprises an insulation layer formed between the top surfaces of the electric conductive layer and the exposed heating layer, and the bottom surface of the cavitation layer.

16. The ink-jet print head according to claim 9, wherein the ink chamber is surrounded about its periphery by an ink chamber barrier laminated on the protective layer, and covered on a top surface by a nozzle plate, which is laminated on the top surface of the ink chamber barrier and through which the nozzle is formed.

17. The ink-jet print head according to claim 9, wherein the nozzle and the ink feeding passage are coaxially located.

18. The ink-jet print head according to claim 9, wherein the protective layer further comprises:

an insulation layer formed between the top surfaces of the electric conductive layer and the exposed heating layer, and the bottom surface of the cavitation layer, wherein the insulation layer is comprised of silicon nitride (SiNx); and the bottom surface of the ink chamber baffler covers opposite ends of the cavitation layer and a top surface of the insulation layer.

19. A protective layer of an ink-jet print head, which is formed on the top of a heating layer for heating ink charged in an ink chamber of the ink-jet print head, the protective layer comprising:

a cavitation layer for preventing the heating layer from being mechanically fractured, wherein the cavitation layer is formed by sequentially laminating at least two types of thin film layers, which are formed of different materials, on the top of the heating layer, wherein the cavitation layer comprises at least one first thin film layer type formed of tantalum (Ta), and at least one second thin film layer type formed of tantalum nitride ($TaN_x$), and wherein the first thin film layers are formed having a substantially equal thickness, and the second thin film layers are formed having a substantially equal thickness, and wherein the thickness T of the cavitation layer is defined by the following equation:

$$T=nt_1+(n+1)t_2$$

wherein T is a total thickness of the cavitation layer, n is the number of first thin film layers, $t_1$ is a thickness of each first thin film layer, and $t_2$ is a thickness of each second thin film layer.

20. The protective layer according to claim 19, wherein the second thin film layer is formed by the nitrification of the Ta.

21. The protective layer according to claim 19, wherein the cavitation layer is formed by alternately and repeatedly laminating at least two types of thin film layers.

22. The protective layer according to claim 21, wherein the thickness of the cavitation layer is substantially equal to the total of respective thicknesses of the first and second thin film layers.

23. The protective layer according to claim 19, wherein at least one of the uppermost and lowermost surfaces of the cavitation layer is provided with the second thin film layer.

24. The protective layer according to claim 19, wherein the first thin film layers and second thin film layers are formed having a substantially equal thickness.

25. The protective layer according to claim 19, further comprising an insulation layer formed between the heating layer and the cavitation layer.

26. The protective layer according to claim 19, wherein the cavitation layer substantially prevents mechanical fracture due to a cavitation force generated when ink bubbles collapse or due to oxidization.

27. An ink-jet print head comprising:

a main substrate;

an ink chamber formed on the main substrate to be capable of receiving ink introduced through an ink feeding passage, wherein the ink chamber is connected with a nozzle for ejecting ink droplets at a side thereof;

a heating layer laminated on the bottom of the ink chamber;

an electric conductive layer laminated on the top surface of the heating layer in a given shape such that a predetermined area of the heating layer is exposed in the interior of the ink chamber; and a protective layer laminated over the electric conductive layer and the heating layer, wherein the protective layer comprises a cavitation layer, formed having at least two types of thin film layers which are formed of different materials, and which are alternately and repeatedly laminated over the heating layer and the electric conductive layer, wherein the cavitation layer comprises a plurality of first thin film layer types formed of tantalum (Ta) and a plurality of second thin film layer types formed of tantalum nitride ($TaN_x$).

28. The ink-jet print head according to claim 27, wherein the plurality of second thin film layers are formed by nitrification of the Ta.

29. The ink-jet print head according to claim 27, wherein the thickness of the cavitation layer is substantially equal to the total of respective thicknesses of the first and second thin film layers.

30. The ink-jet print head according to claim 27, wherein at least one of the uppermost and lowermost surfaces of the cavitation layer is provided with the second thin film layer.

31. The ink-jet print head according to claim 27, wherein the plurality of first thin film layers are formed having a substantially equal thickness, and the plurality of second thin film layers are formed having a substantially equal thickness, and wherein the thickness T of the cavitation layer is defined by the following equation:

$$T=nt_1+(n+1)t_2$$

wherein T is a total thickness of the cavitation layer, n is the number of first thin film layers, $t_1$ is a thickness of each first thin film layer, and $t_2$ is a thickness of each second thin film layer.

32. The ink-jet print head according to claim 27, wherein the protective layer further comprises an insulation layer formed between the top surfaces of the electric conductive layer and the exposed heating layer, and the bottom surface of the cavitation layer.

33. The ink-jet print head according to claim 27, wherein the ink chamber is surrounded about its periphery by an ink chamber barrier laminated on the protective layer, and covered on a top surface by a nozzle plate, which is laminated on the top surface of the ink chamber barrier and through which the nozzle is formed.

34. The ink-jet print head according to claim 27, wherein the nozzle and the ink feeding passage are coaxially located.

35. The ink-jet print head according to claim 27, wherein the protective layer further comprises:

an insulation layer formed between the top surfaces of the electric conductive layer and the exposed heating layer, and the bottom surface of the cavitation layer, wherein the insulation layer is comprised of silicon nitride (SiNx); and the bottom surface of the ink chamber barrier covers opposite ends of the cavitation layer and a top surface of the insulation layer.

* * * * *